United States Patent [19]

Manolescu

[11] 4,383,002

[45] May 10, 1983

[54] JEWELLERY POST

[75] Inventor: Dorin T. Manolescu, Toronto, Canada

[73] Assignee: French Jewellery Company of Canada Limited, Toronto, Canada

[21] Appl. No.: 297,393

[22] Filed: Aug. 28, 1981

[51] Int. Cl.[3] ..... A44C 7/00

[52] U.S. Cl. ..... 428/580; 428/577; 428/578; 428/579; 63/12; 63/20

[58] Field of Search ..... 428/577, 578, 579, 580; 63/12, 20

[56] References Cited

U.S. PATENT DOCUMENTS 4,307,582 12/1981 Mancini ..... 63/12

*Primary Examiner*—Veronica O'Keefe

*Attorney, Agent, or Firm*—Robert F. Delbridge; Arne I. Fors

[57] ABSTRACT

A jewellery post has an elongated member with a longitudinally extending passage adjacent one end, and a plug of bonding material within the passage adjacent this end. The bonding plug is a sliding fit in the passage and has a length which is short compared to the length of the tubular member.

11 Claims, 4 Drawing Figures

JEWELLERY POST

This invention relates to jewellery posts, that is to say small shaft-like members which are used as parts of earrings and lapel pins, the shaft-like member being the part which passes through a pierced ear or a lapel and which carries a decorative article at one end and a suitable retaining device at the other end.

Jewellery posts, especially those used as parts of earrings, are very small, and the attachment of the decorative articles to the posts is consequently not an easy operation. Usually, the attachment operation is carried out by hand by holding the post against the decorative article and applying heat and bonding material to the end of the post engaging the decorative article. Such an operation is naturally tedious and time consuming and requires considerable skill and patience on the part of the operator.

It is therefore an object of this invention to provide a jewellery post which is more easily attachable to a decorative article.

According to the invention, a jewellery post comprises an elongated member having a longitudinally-extending internal passage adjacent one end thereof, and a plug of bonding material within the passage adjacent said one end, the bonding plug being a sliding fit in the passage and having a length which is short compared to the length of the elongated member.

Thus, it is merely necessary for the post to be held against a decorative article and for the bonding material to be actuated. The tubular member may be of gold or silver and the bonding material may be heat softenable, for example, a solder.

The jewellery post in accordance with the present invention is therefore especially suitable for use in an automatic attachment operation. A further advantage of the bonding plug is that it acts as a reinforcement of the elongated member at its point of attachment to the decorative article.

The tubular member may have an external diameter from about 0.025 to about 0.05 inch and an internal diameter of from about 0.015 to about 0.04 inch. Preferably, the tubular member has an external diameter of from about 0.028 to about 0.032 inch and an internal diameter of from about 0.018 to about 0.022 inch. The tubular member may have a length of from about 0.35 to about 0.625 inch, and the bonding plug may have a length of from about 0.02 to about 0.1 inch. The passage may extend for substantially the whole length of the tubular member.

Figure 1:
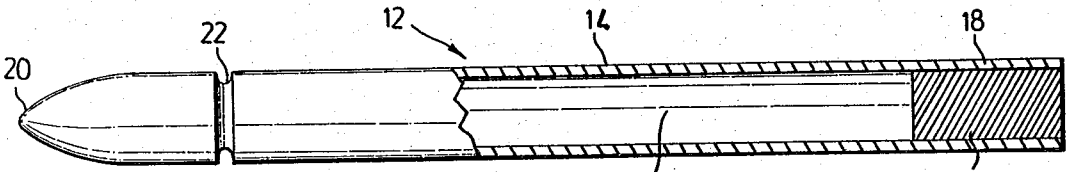
Figure 2:
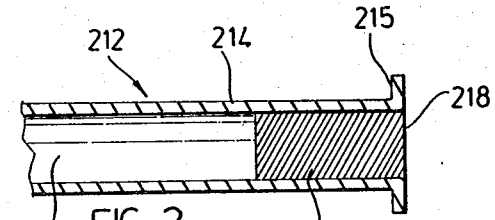
Figure 3:
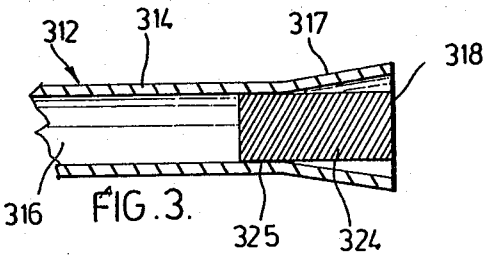
Figure 4:
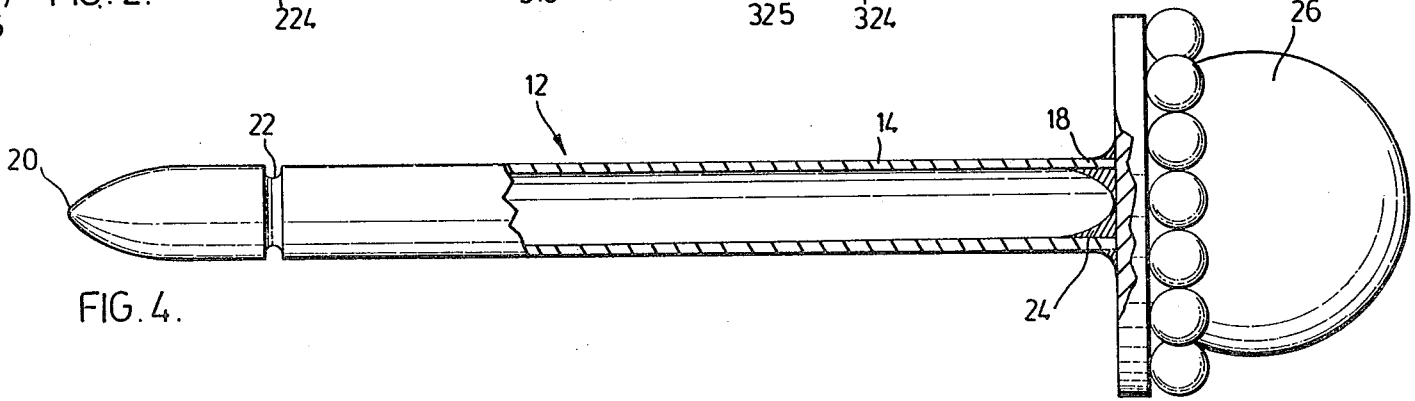

Embodiments of the invention will now be described by way of example, with reference to the accompanying drawings, of which:

FIG. 1 is a sectional side view of a jewellery post in accordance with one embodiment, FIG. 2 is a similar view of one end portion of a jewellery post in accordance with a second embodiment, FIG. 3 is a similar view of one end portion of a jewellery post in accordance with a third embodiment, and FIG. 4 is a similar view of the jewellery post of FIG. 1 attached to a decorative article.

Referring first to FIG. 1 of the drawings, a jewellery post 12 comprises a tubular member 14 of gold with an external diameter of 0.03 inch and a length of 0.4 inch. The tubular member 14 has an internal passage 16 with a diameter of 0.02 inch extending over substantially the whole length of the member from an open end 18 to a pointed closed end 20. Near the pointed end 20, tubular member 14 has an external annular groove 22 to enable a suitable retaining device to be attached thereto in known manner.

A plug 24 of gold solder is located in the passage 16. The plug 24 is 0.05 inch in length and is a sliding fit in the passage 16, the plug 24 having been inserted therein during manufacture of the post 12.

FIG. 2 shows a modified post 212 whose tubular member 214 has a flange 215 at the open end 218. A plug 224 of gold solder is a sliding fit in the passage 216 similarly to the embodiment of FIG. 1.

FIG. 3 shows another modified post 312 whose tubular member 314 has an outwardly flared portion 317 adjacent to the open end 318. The plug 324 of gold solder is slightly longer than the flared portion 317 and is a sliding fit in the adjacent unflared portion 325 of the tubular member 314.

Referring now to FIG. 4, the post of FIG. 1, for example, is readily attachable to a decorative article 26 by holding the post 12 against the decorative article 26 and applying heat to the end 18 of the tubular member 14 so that the gold solder plug 24 melts and secured the post 12 to the decorative article 26.

The advantages of the invention will be clear to a person skilled in the art from the foregoing description. Other embodiments of the invention will be readily apparent to a person skilled in the art, the scope of the invention being defined in the appended claims.

What I claim as new and desire to protect by Letters Patent of the United States is:

1. A jewellery post comprising an elongated member having a longitudinally extending passage adjacent one end thereof, and a plug of bonding material within the passage adjacent said one end, said bonding plug being a sliding fit in the passage and having a length which is short compared to the length of the tubular member.

2. A jewellery post according to claim 1 wherein the tubular member has an external diameter from about 0.025 to about 0.05 inch and an internal diameter of from about 0.015 to about 0.04 inch.

3. A jewellery post according to claim 2 wherein the tubular member has an external diameter of from about 0.028 to about 0.032 inch and an internal diameter of from about 0.018 to about 0.022 inch.

4. A jewellery post according to claim 1 wherein the tubular member has a length of from about 0.35 to about 0.625 inch.

5. A jewellery post according to claim 1 wherein the bonding plug has a length of from about 0.02 to about 0.1 inch.

6. A jewellery post according to claim 1 wherein the bonding material is heat-softenable material.

7. A jewellery post according to claim 1 wherein the tubular member comprises a metal selected from the group consisting of gold and silver.

8. A jewellery post according to claim 1 wherein the passage extends for substantially the whole length of the tubular member.

9. A jewellery post comprising a metal tubular member with a length in the range of from about 0.35 to about 0.62 inch, and an external diameter in the range of from about 0.025 to about 0.05 inch, said tubular member having a longitudinally extending internal passage adjacent said one end, said bonding plug being a sliding fit in the passage and having a length which is short compared to the length of the tubular member.

10. A jewellery post according to claim 9 wherein the tubular member has an external diameter from about 0.028 to about 0.022 inch, and the passage has a diameter from about 0.018 to about 0.032 inch.

11. A jewellery post according to claim 9 wherein the bonding plug has a length of from about 0.02 to about 0.1 inch.

* * * * *